US005273370A

United States Patent [19]

Bland et al.

[11] Patent Number: 5,273,370

[45] Date of Patent: Dec. 28, 1993

[54] HOLE PUNCHING DEVICE FOR A RINGED NOTEBOOK

[76] Inventors: Robert E. Bland, 11611 Lew Jones Rd., Dewitt, Va. 23840; Peter Van Davelaar, P.O. Box 9052, Richmond, Va. 23225-0752

[21] Appl. No.: 973,402

[22] Filed: Nov. 9, 1992

[51] Int. Cl.[5] ..... B42F 13/40

[52] U.S. Cl. ..... 402/1; 402/80 R

[58] Field of Search ..... 402/1, 32, 33, 39, 41, 402/79

[56] References Cited

U.S. PATENT DOCUMENTS 3,349,774 10/1967 Ryan ..... 402/1

3,944,373 3/1976 Farjon et al. ..... 402/1

4,640,451 2/1987 Steiner ..... 402/2 X 4,729,688 3/1988 Manz ..... 402/2

4,749,297 6/1988 Roy ..... 402/2

*Primary Examiner*—Paul A. Bell

*Attorney, Agent, or Firm*—Norman B. Rainer

[57] ABSTRACT

A device for punching holes in paper is adapted to be positioned within the binder mechanism of a loose leaf notebook. The device employs an integral receiving base having a bore and cutting aperture. A punch member is slidably disposed within the bore above the aperture and adapted to move in a reciprocal manner in orthogonal relationship to the notebook.

11 Claims, 9 Drawing Sheets

HOLE PUNCHING DEVICE FOR A RINGED NOTEBOOK

BACKGROUND OF THE INVENTION

1. Field of the Invention

This invention relates to loose leaf notebook binders, and more particularly concerns a binder having means for punching holes in sheets of paper, thereby enabling said paper to be held by said binder.

2. Description of the Prior Art

Ordinary loose-leaf binder mechanisms well-known in the art utilize two identical elongated rectangular hinge plates having opposed inner and outer long edges. The plates lie in abutment at their inner edges, which are hingedly joined. The plates are concealed beneath a housing having a generally arcuate upper surface whose centerline is directly above said inner edges. Opposed retaining lips downwardly directed from said upper surface retain the outer long edges of the plates.

Mating arms are attached to the plates, each arm constituting one half of a circular ring. When the abutting inner edges are forced upwardly toward the upper surface of the housing, the plates snap into an inverted V-shaped juxtaposition with attendant separation of the arms. Downward movement of said inner edges causes the plates to pass through coplanar into V-shaped juxtaposition, causing closing of the arms.

The binder mechanism is generally attached to the central back panel of the notebook by at least two spaced apart posts that extend through the plates and engage the arcuate upper surface on its centerline.

Numerous hole punching devices have been disclosed in the prior art. Various adaptations to ringed notebooks have been employed in attempts to simultaneously punch a linear array of holes adjacent one edge of a sheet of paper. For example, U.S. Pat. No. 3,349,774 to Ryan discloses a loose-leaf notebook having rings formed from flat sheet metal, each having paired facing substantially flat panels. The panels are equipped with interactive male and female punch dies. A page may be inserted between the open rings and the facing plates. When the rings are snapped shut, an array of holes is punched. The rings must be opened to accommodate the page; closed to punch the holes; opened to release the page; then closed to bind the page. The action of the rings snapping shut may cause damage to the page. Furthermore, Ryan's hole punching plates create an obstruction to free page-turning movement of pages held by the loose-leaf rings, particularly when the holes of some pages have been punched slightly far from the edge of the page. Moreover, the process of manufacturing loose-leaf rings from flat sheet metal may be expensive, rendering the notebook design impractically expensive.

U.S. Pat. No. 4,749,297 to Roy discloses a similar hole punch device wherein a hole-punching die mechanism is located beneath the loose-leaf binder mechanism. This device punches the array of holes upon the opening of the rings. Due to the position f the hole-punching means, the number of pages which may be simultaneously punched in a stack is limited. The Roy device also appears to be expensive to manufacture due to the numerous moving parts.

In those instances where hole-punching is achieved by causing separated male and female punching members to travel toward each other to act upon intervening paper, alignment problems are encountered which cause malfunction such as jamming or improper hole-punching. Such misalignment problems are accentuated when one punching member is associated with the binder mechanism and the other punching member is associated with the central back panel upon which the binder mechanism is mounted. By incorporating both punching members into the binder mechanism in an attempt to overcome the misalignment problem, impairment is often encountered in the more important function of the binder mechanism, namely securing a multitude of pages in a freely turnable manner.

Accordingly, it is an object of the present invention to provide a multi-ring loose-leaf binder mechanism having means for simultaneously punching a linear array of holes in a single sheet of paper, or stack of paper sheets.

It is another object of the present invention to provide a binder mechanism as in the foregoing object having means for punching holes merely upon manipulation of said binder mechanism or its binder rings.

It is a further object of this invention to provide a binder mechanism of the aforesaid nature resistant to malfunction.

It is yet another object of the present invention to provide a binder mechanism of the aforesaid nature wherein the hole-punching feature does not interfere with the page-holding feature of the rings.

Further objects of this invention are to provide a binder of the aforesaid nature which is simple to operate, has relatively few moving parts, is durable, and amenable to low cost manufacture.

Other beneficial objects and advantages will be apparent from the following description.

SUMMARY OF THE INVENTION

The above and other beneficial objects and advantages are accomplished in accordance with the present invention by an improvement in an otherwise conventional loose leaf binder mechanism comprised of:

a) paired elongated hinge plates having outer edges and interactive inner edges, b) a plurality of interactive arms having free distal extremities, and proximal extremities affixed to said hinge plates at a uniform spacing, said arms positioned to form mating pairs such that a closed binding ring is formed by the mating engagement of said distal extremities, and c) housing means adapted to embrace said hinge plates and urge said inner edges together, whereby movement of said plates between open and closed states of said arms is achieved with a snapping and locking effect, said housing having an upper surface having a longitudinal center axis positioned above said inner edges, said improvement comprised of a hole punching device associated with each pair of arms and comprised of:

d) an integral receiving base having a bore elongated between upper and lower extremities and orthogonally disposed to said upper surface, a platform disposed below said lower extremity and spaced therefrom by a distance constituting a paper-receiving gap, an abutment surface laterally spaced from said bore at an elevation between said platform and said lower extremity, and a cutting aperture positioned in said platform in centered alignment with said bore, and e) a punch member having top and bottom extremities and slidably held within said bore, said bottom extremity configured to enter said cutting aperture, and said top extremity configured to be acted upon by said binder mechanism to propel said punch member in reciprocating manner within said bore.

In preferred embodiments, the platform member has an underside provided with a compartment to confine debris resulting from the paper-punching operation. Anchor means may also be associated with said underside to enable the hole punching device to be attached to the center back panel of the notebook. In certain embodiments, said anchor means further serve to secure the binder mechanism to the notebook.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
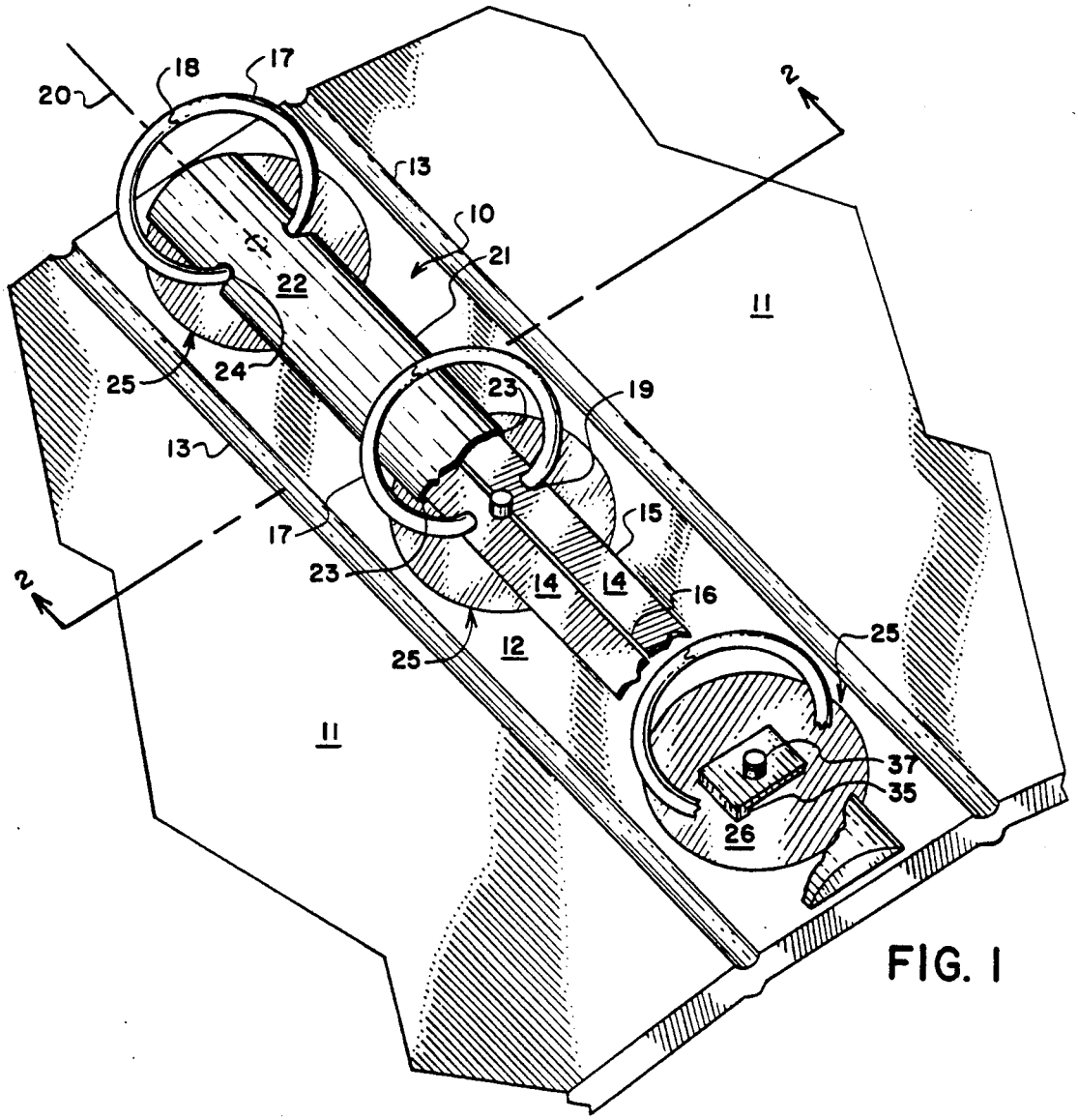
FIG. 1 is a top perspective view of an improved binder mechanism employing three hole punching devices of the present invention, portions being broken away in layers to reveal interior details.

Referring to FIG. 1, a binder mechanism 10 modified in accordance with the present invention is shown in functional association with an otherwise conventional binder comprised of paired cover panels 11 and elongated central panel 12. Parallel straight zones 13 bordering central panel 12 constitute hinges which integrally join the central panel and cover panels. Binder mechanism 10, disposed upon central panel 12, is comprised of paired elongated hinge plates 14 having outer edges 15 and interactive inner edges 16.

Arms 17, of substantially semi-circular or C-shape and having free distal extremities 18 and proximal extremities 19, are attached at their proximal extremities to said hinge plates. The arms are positioned to form mating pairs such that a closed binding ring is formed by the mating engagement of said distal extremities, which are adapted to interlock with one another. The arms are disposed in planes orthogonal to central panel 12 at equally spaced intervals along said central panel. In other embodiments, the arms can be configured in shapes other than C-shape.

A housing 21, positioned above hinge plates 14, is comprised of arcuate upper surface 22 and opposed facing retaining lips 23.1 The longitudinal centerline 20 of surface 22 is disposed directly above inner edges 16 of said hinge plates. The retaining lips 23 serve to hold outer edges 15 of plates 14, thereby urging the plates to interact at their inner edges with a snapping effect. A plurality of holes 24 are located in surface 22 to permit the emergence and movement of arms 17. A hole-punching device 25 of the present invention is disposed within binder mechanism 10 between each pair of arms 17. The hole-punching devices are preferably of identical construction for use within a given binder.

Referring to FIGS. 2-5, a first embodiment of the hole-punching device of the present invention is shown comprised of integral receiving base 26 of circular perimeter, and punch member 37. Base 26, which may be fabricated of metal or plastic by a molding operation, is comprised of centered stem portion 60 having bore 27 of uniform cross-sectional configuration elongated between upper and lower extremities 28 and 29, respectively, said bore having an axis 30 orthogonally disposed to upper surface 22 of said housing. Stem portion 60 is a continuous integral extension of support ledge 62. A flat platform 33, disposed in substantially parallel relationship to ledge 62, is spaced below lower extremity 29 by a distance constituting a paper-receiving gap 34. The height of gap 34 determines the number and/or thickness of pages that can be punched.

An abutment surface 35 is laterally spaced from axis 30 below extremity 29. A cutting aperture 36 is positioned in said platform in centered alignment with bore 27. The distance of spacing of surface 35 from axis 30 establishes the separation distance of the edge of a paper and the hole punched in it.

Punch member 37, of hollow construction and having top and bottom extremities 38 and 39, respectively, is slidably held within bore 27. Bottom extremity 39 is configured to achieve close-fitting penetrative insertion of aperture 36. Top extremity 38 is provided with an annular groove 47 that receives surface 22. The lower extremity of said punch member is provided with an outwardly directed flange 48 adapted to reside within a radially enlarged portion 49 of bore 27. Such construction limits upward travel of the punch member. Upper and lower shoulders 45 and 46, respectively, outwardly directed from stem portion 60 interact with the inner edges of plates 14.

Figure 2:
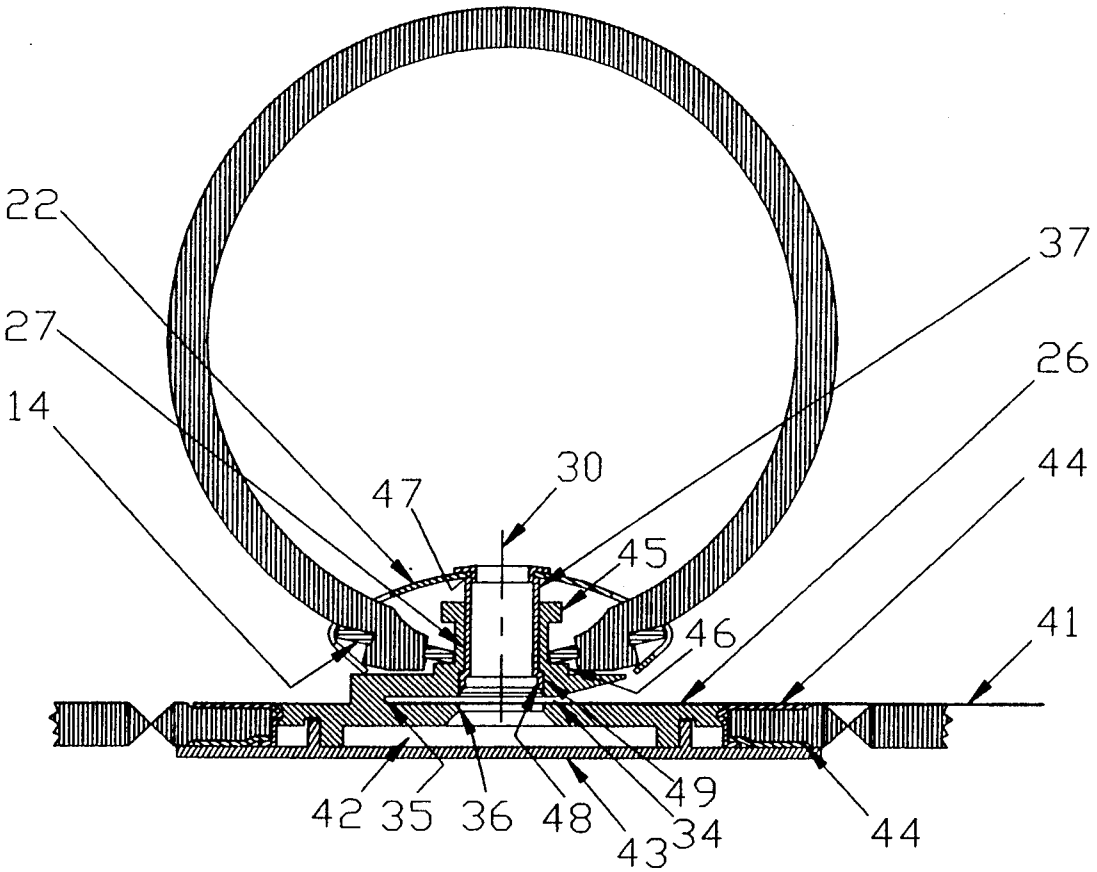
FIG. 2 is an enlarged sectional view taken in the direction of the arrows upon the line 2—2 of FIG. 1, and representing a vertical sectional view of a first embodiment of the hole punching device of this invention.
Figure 3:
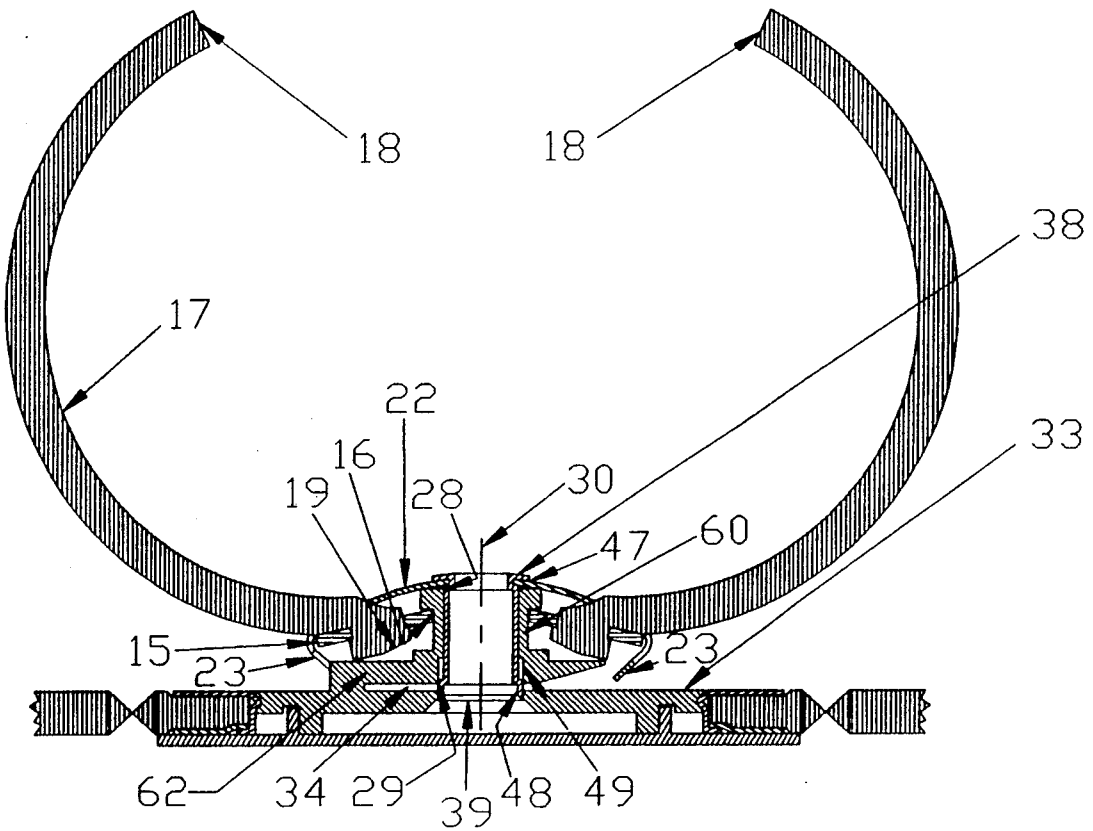
FIG. 3 is a view similar to that of FIG. 2 but showing the notebook rings in their open position.
Figure 4:
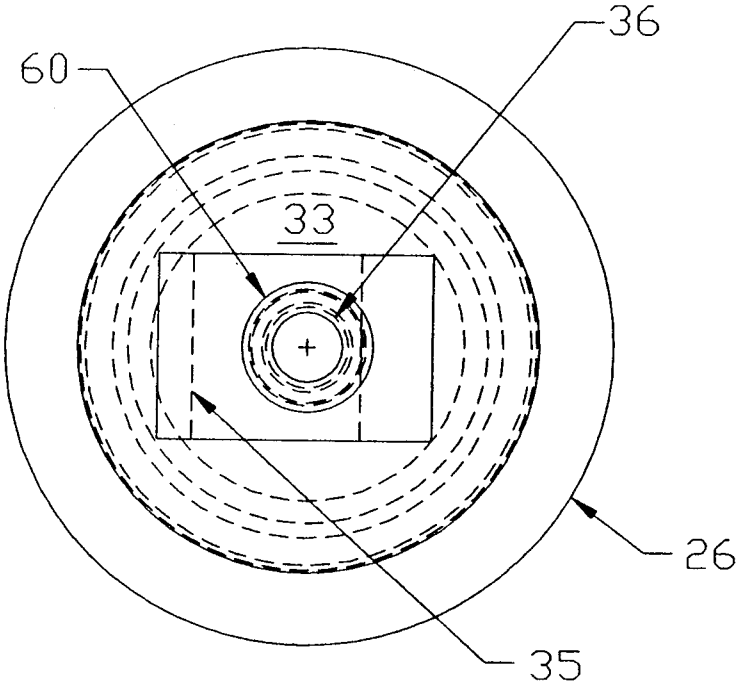
FIG. 4 is a top view of the embodiment of FIG. 2.
Figure 5:
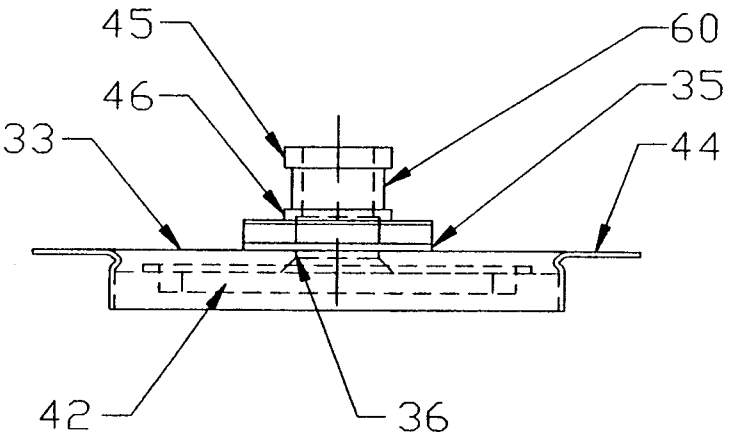
FIG. 5 is a side view taken from the right of the embodiment of FIG. 2.

In operation, a piece of paper 41 is placed so that its straight edge is seated against surface abutment surface 35 while arms 17 are in their closed position. The arms are then forced to their open position, as shown in FIG. 3. Such action urges punch member 37 and housing 21 downwardly, causing bottom extremity 39 to punch a hole through paper 41 and enter aperture 36. The circle thereby punched out of the paper is driven below platform 33. In the illustrated embodiment, a confining region 42 is disposed below said platform for collecting the punched-out i circles. A removable cover 43 may be associated with region 42. When the arms are forced to their closed position, as shown in FIG. 2, punch member 37 and housing 21 are raised, permitting removal of paper 41. It is to be noted that, because of the embracement of the paper between ledge 62 and platform 33, it is unlikely that tearing of the paper will occur during lifting of the punch member. The reciprocating motion of the punch member within close-fitting bore 27 minimizes malfunction of the device. Because of its location beneath upper surface 22, the hole punching device does not interfere with the primary function of the arms to hold a multitude of pages in an easily turnable array.

Anchor means in the form of clasping appendages 44 are disposed about the perimeter of platform 33 for the purpose of attaching the device to the center panel of the binder. Such manner of attachment may also serve to anchor the binder mechanism to said center panel. When the hole-punching device is provided with a collecting region and removable cover 43, said cover is caused to penetrate said center panel, thereby providing serviceable access to said cover. Cover 43 may be transparent, or may be provided with indicia which produces a distinctive appearance.

Figure 6:
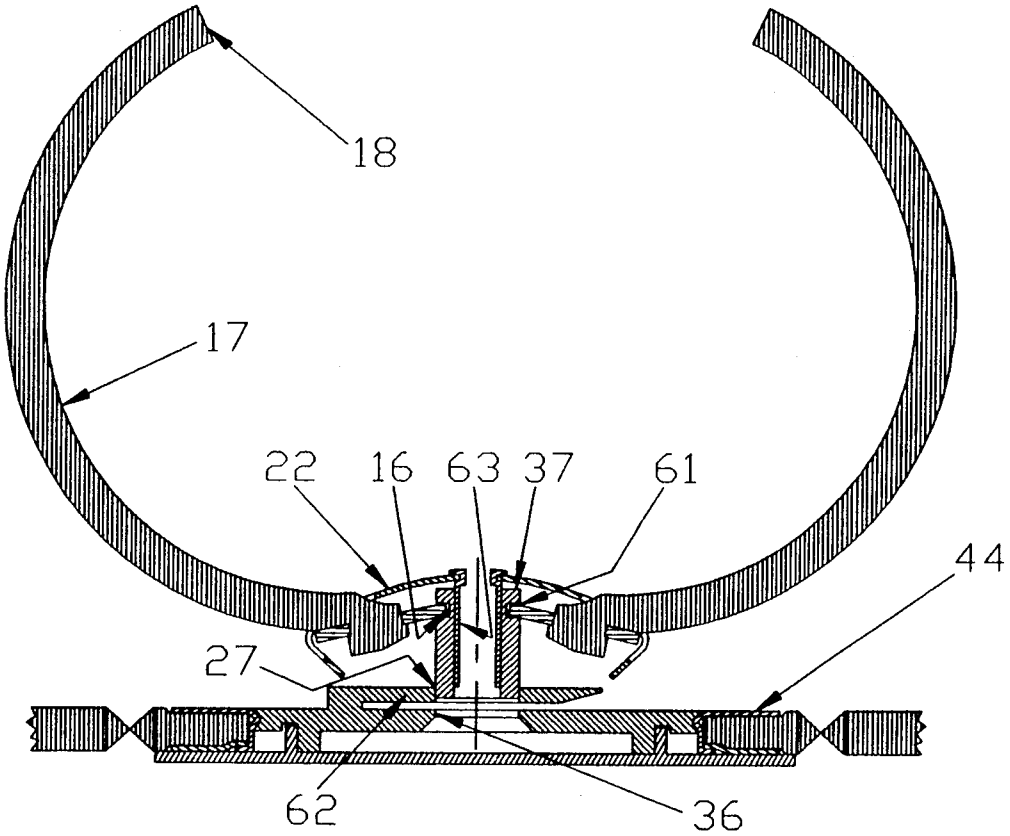
FIG. 6 is a vertical sectional view of a second embodiment of the hole punching device of this invention.

In the second embodiment illustrated in FIG. 6, receiving groove 61 which may be in the form of opposed notches or an annular groove is disposed adjacent the upper top extremity of hollow punch member 37 for the purpose of engaging inner edges 16 of plates 14. By virtue of such manner of construction, holes are punched by closing motion of arms 17. It is to be noted that this embodiment has no stem portion 60. Bore 27 is instead disposed within ledge 62. Furthermore, punch member 37 is adapted to reciprocate upon guide member 63 disposed within punch member 37 and affixed to surface 22.

Figure 7:
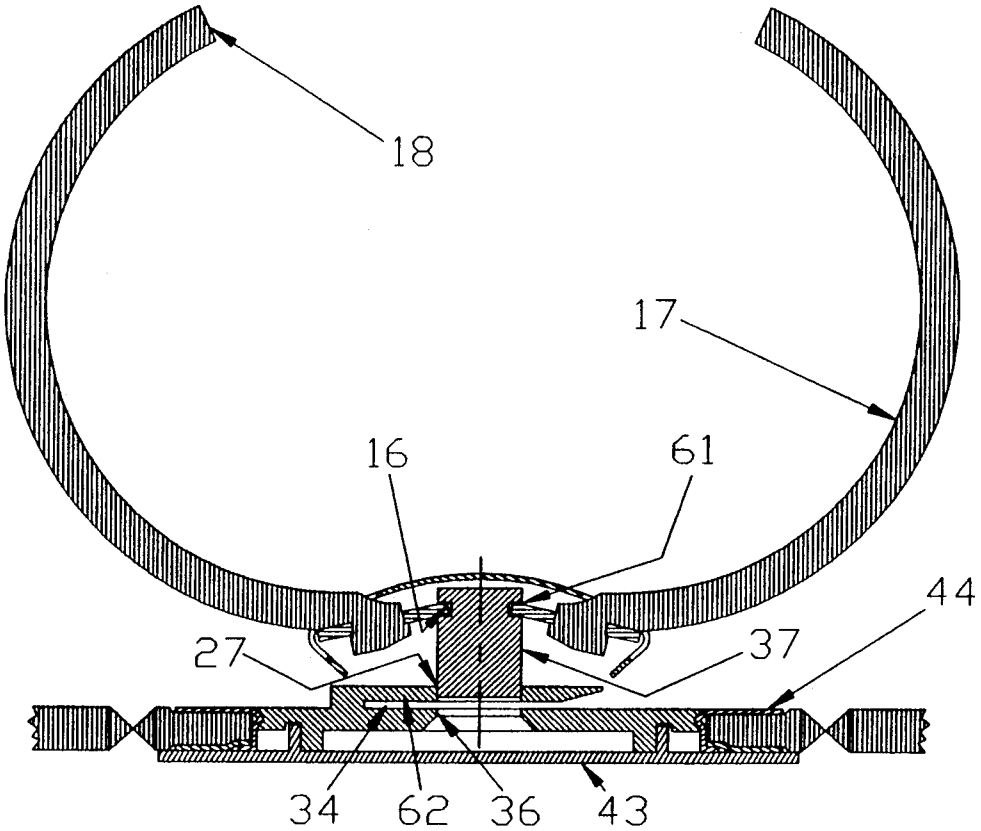
FIG. 7 is a vertical sectional view of a third embodiment of the hole punching device.

The third embodiment illustrated in FIG. 7 is somewhat similar to the embodiment of FIG. 6 with the exception that no guide member is utilized in conjunction with punch member 37.

Figure 8:
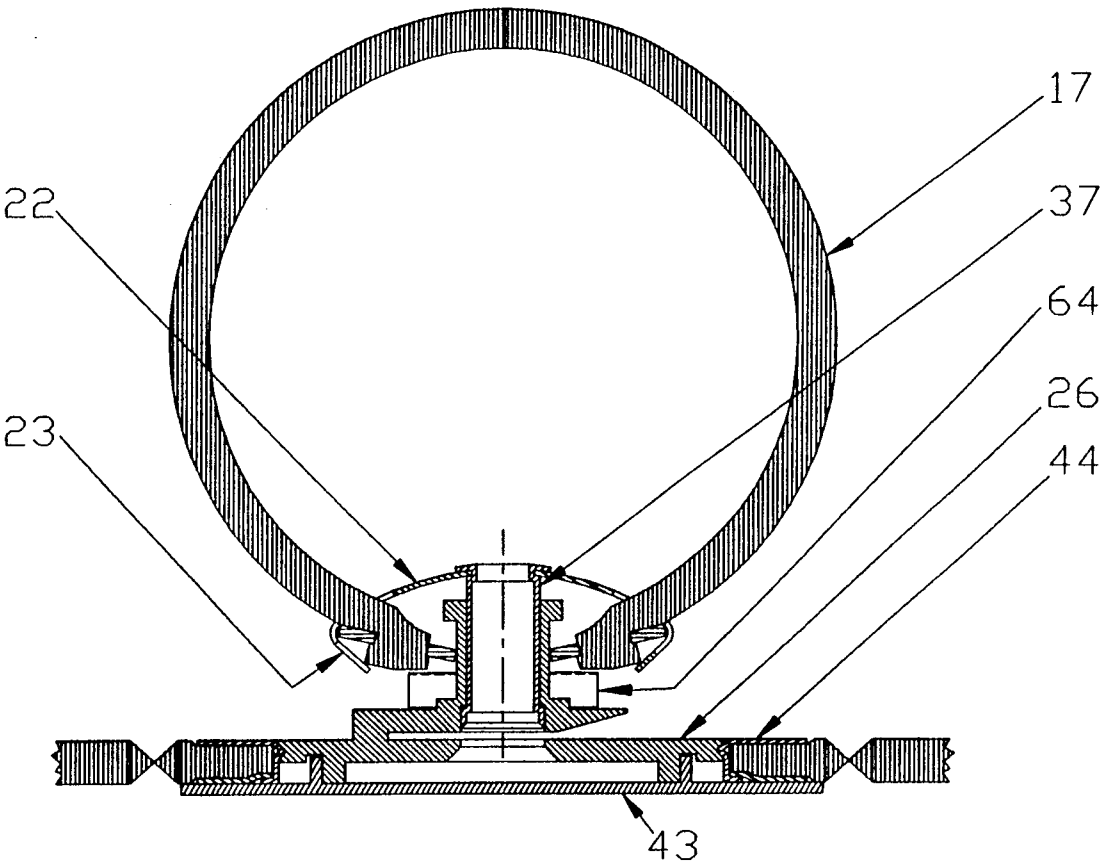
FIG. 8 is a vertical sectional view of a fourth embodiment.
Figure 9:
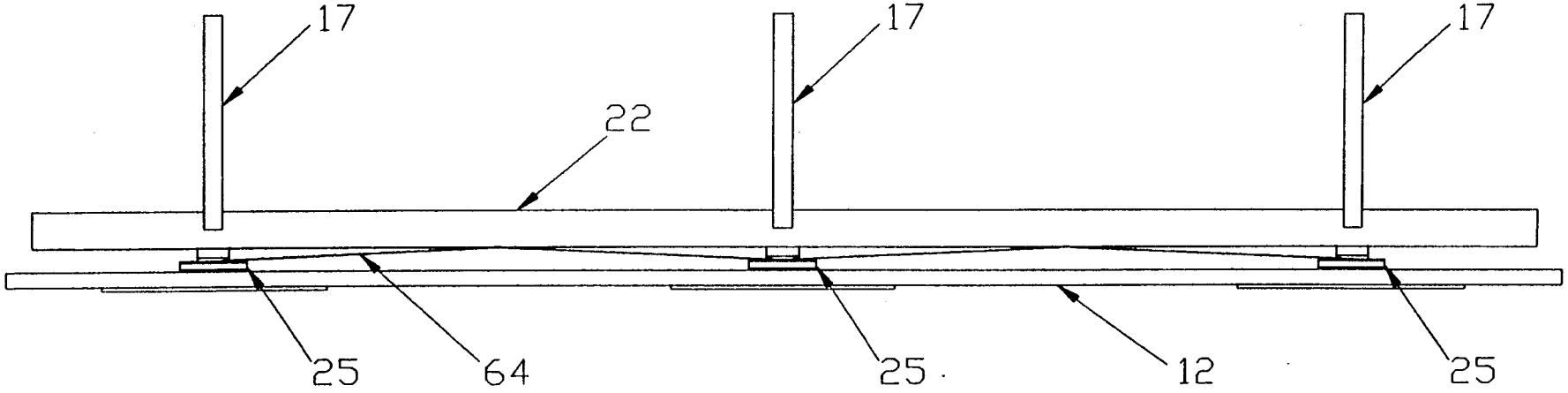
FIG. 9 is a side view of a binder equipped with the holepunching device of FIG. 8.

In the fourth embodiment illustrated in FIGS. 8 and 9, a spring 64 is disposed between hinge plates 14 and ledge 62. Punch member 37 is attached at its upper extremity to surface 22. By virtue of such manner of construction, holes are punched in paper when the binder mechanism is forced downwardly against the binder. Spring 64 restores the punch member to its upward position. It is to be noted that in such mode of function, movement of arms 17 is not required to achieve hole punching.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A hole punching device adapted for use in association with a loose leaf binder mechanism having a plurality of interactive arms, said hole punching device comprised of:

a) an integral receiving base including a bore having upper and lower extremities, a platform disposed below said lower extremity and spaced therefrom by a distance constituting a paper-receiving gap, an abutment surface laterally spaced from said bore at an elevation between said platform and said lower extremity, and a cutting aperture positioned in said platform in centered alignment with said bore, and b) a punch member having top and bottom extremities and slidably disposed within said bore, said bottom extremity configured to enter said cutting aperture, said punch member configured to be acted upon by said binder mechanism to propel said punch member in reciprocating manner within said bore.

2. The device of claim 1 wherein said platform has an underside provided with a compartment to confine debris resulting from the punching of holes in paper.

3. The device of claim 2 wherein said compartment is provided with a removable cover.

4. The device of claim 3 wherein said cover is transparent.

5. The device of claim 3 wherein said cover contains visibly distinctive indicia.

6. The device of claim 1 wherein said platform has anchor means associated therewith to facilitate attachment to a loose leaf binder.

7. In a conventional loose leaf binder mechanism comprised of:

a) paired elongated hinge plates having outer edges and interactive inner edges, b) a plurality of interactive arms having free distal extremities, and proximal extremities affixed to said hinge plates at a uniform spacing, said arms positioned to form mating pairs such that a closed binding ring is formed by the mating engagement of said distal extremities, and c) housing means adapted to embrace said hinge plates and urge said inner edges together, whereby movement of said plates between open and closed states of said arms is achieved with a snapping and locking effect, said housing having an upper surface having a longitudinal center axis positioned above said inner edges, the improvement comprising:

d) a hole punching device associated with each pair of arms and comprised of:

1) an integral receiving base including a bore having upper and lower extremities and orthogonally disposed to said upper surface, a platform disposed below said lower extremity and spaced therefrom by a distance constituting a paper-receiving gap, an abutment surface laterally spaced from said bore at an elevation between said platform and said lower extremity, and a cutting aperture positioned in said platform in centered alignment with said bore, and 2) a punch member having top and bottom extremities and slidably disposed within said bore, said bottom extremity configured to enter said cutting aperture, said punch member configured to be acted upon by said binder mechanism to propel said punch member in reciprocating manner within said bore.

8. The improvement of claim 4 wherein said punch member is acted upon by the inner edges of said hinge plates.

9. The improvement of claim 4 wherein said punch member is acted upon by said upper surface of said housing.

10. The improvement of claim 7 wherein spring means are incorporated between said hinge plates and receiving base, and said punch member is attached to said upper surface, said spring means serving to restore said punch member to an upward position following a downward motion which achieves hole-punching of paper disposed within said paper-receiving gap.

11. The improvement of claim 7 wherein said punch member is acted upon by movement of said arms.

* * * * *